US009215779B2

(12) United States Patent
Restrepo et al.

(10) Patent No.: US 9,215,779 B2
(45) Date of Patent: Dec. 15, 2015

(54) LIGHT SWITCH AND CONTROL DEVICE HAVING A TOUCH SCREEN INTERFACE

(75) Inventors: Carlos Eduardo Restrepo, Atlanta, GA (US); Darron Kirby Lacey, Peachtree City, GA (US); Richard A. Pabst, Jr., Fayetteville, GA (US); Thomas Landrum, Fayetteville, GA (US); Sheldon Zhang, Shanghai (CN); Lily Du, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 844 days.

(21) Appl. No.: 13/435,621

(22) Filed: Mar. 30, 2012

(65) Prior Publication Data

US 2013/0257315 A1 Oct. 3, 2013

(51) Int. Cl.
*F21V 23/04* (2006.01)
*H05B 37/02* (2006.01)

(52) U.S. Cl.
CPC ..... *H05B 37/0209* (2013.01); *Y10T 307/74* (2015.04)

(58) Field of Classification Search
USPC ..... 315/160–176
See application file for complete search history.

(56) References Cited

U.S. PATENT DOCUMENTS

| | | | | |
|---|---|---|---|---|
| 5,637,863 | A | 6/1997 | Sanborn et al. | |
| 6,424,094 | B1 * | 7/2002 | Feldman | 315/169.3 |
| 2002/0086567 | A1 * | 7/2002 | Cash, Jr. | 439/106 |
| 2004/0080267 | A1 * | 4/2004 | Cok | 313/512 |
| 2005/0121602 | A1 | 6/2005 | Peng et al. | |
| 2005/0219200 | A1 * | 10/2005 | Weng | 345/104 |
| 2008/0140546 | A1 * | 6/2008 | Finley et al. | 705/29 |
| 2008/0151458 | A1 * | 6/2008 | Beland et al. | 361/114 |
| 2009/0243517 | A1 * | 10/2009 | Verfuerth et al. | 315/315 |
| 2012/0037274 | A1 * | 2/2012 | Henderson | 144/2.1 |
| 2012/0117601 | A1 * | 5/2012 | Yeh et al. | 725/42 |
| 2013/0134996 | A1 * | 5/2013 | Burberry et al. | 324/679 |

* cited by examiner

*Primary Examiner* — Brandon S Cole
(74) *Attorney, Agent, or Firm* — King & Spalding LLP

(57) ABSTRACT

The touch screen lighting control device provides a multitude of graphical user interface (GUI) displays at a touch screen and is capable of detecting location specific selections based on the GUI to determine control actions for lighting devices, fans and other electrical fixtures. The device includes a mounting strap configured to couple the device to an in-wall junction box, a touch screen, and a thin film transistor communicably coupled to the touch screen for displaying the different displays and receiving selections at the touch screen. A glass panel can also be positioned between the touch screen and the thin film transistor. The GUI presents an interactive template to a user, and the touch screen and thin film transistor determines an interaction from the user based on the user interacting with the interactive template displayed on the GUI a the touch screen.

21 Claims, 11 Drawing Sheets

LIGHT SWITCH AND CONTROL DEVICE HAVING A TOUCH SCREEN INTERFACE

TECHNICAL FIELD

The present disclosure relates generally to an in-wall switching device for a lighting fixture and/or fan, and more particularly to in-wall switching or control device having a touch screen interface to control lighting, fan, and/or other electrical functions.

BACKGROUND

The use of touch screens is becoming more common in a number of applications. However, touch screen technology and its applications are evolving. Combination devices, also commonly known as wall fixtures or in-wall switching devices, use mechanical actuators in the form of switches, levers, and/or pushbuttons. The footprint of a combination device, especially for a single gang combination device, which is the most common size of a combination device, is relatively small.

SUMMARY

In general, in one aspect, the disclosure relates to an electrical switch device. The electrical switch device can include a mounting strap coupleable to an in-wall junction box. The electrical switch device can also include a touch screen assembly having a touch screen and a thin film transistor screen communicably coupled to the touch screen. The electrical switch device can also include a housing coupled to the mounting strap. The housing may include a number of surfaces defining a cavity, and the cavity can receive a number of electrical components to electrically couple the touch screen assembly to a source of electrical power.

In another aspect, the disclosure can generally relate to a method for controlling a lighting device. The method can include providing an electrical switch device having a touch screen and a thin film transistor (TFT) screen communicably coupled to the touch screen. The method can also include presenting one of a number of interactive templates on a graphical user interface (GUI) at the TFT screen. The method can further include receiving, at the touch screen, a selection of a portion of the interactive template on the GUI at the TFT screen. The method can also include sending a signal to the lighting device to control a function of the lighting device in response to and corresponding to the selection. The lighting device can include at least a lighting fixture or a ceiling fan. At least a portion of the electrical switch device can be mechanically coupled to a wall.

In yet another aspect, the disclosure can generally relate to a computer readable medium having computer readable program code embodied therein for performing a method for controlling a lighting device. The method can include providing an electrical switch device having a touch screen and a thin film transistor (TFT) screen communicably coupled to the touch screen. The method can also include presenting one of a number of interactive templates on a graphical user interface (GUI) at the TFT screen. The method can further include receiving, at the touch screen, a selection of a portion of the interactive template on the GUI at the TFT screen. The method can also include sending a signal to the lighting device to control a function of the lighting device in response to and corresponding to the selection. At least a portion of the electrical switch device can be mechanically coupled to a wall.

These and other aspects, objects, features, and embodiments will be apparent from the following description and the appended claims.

BRIEF DESCRIPTION OF THE DRAWINGS

The drawings illustrate only exemplary embodiments of an in-wall switching device having a touch screen interface and are therefore not to be considered limiting of its scope, as the in-wall switching device with touch screen interface may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION OF EXEMPLARY EMBODIMENTS

Figure 1:
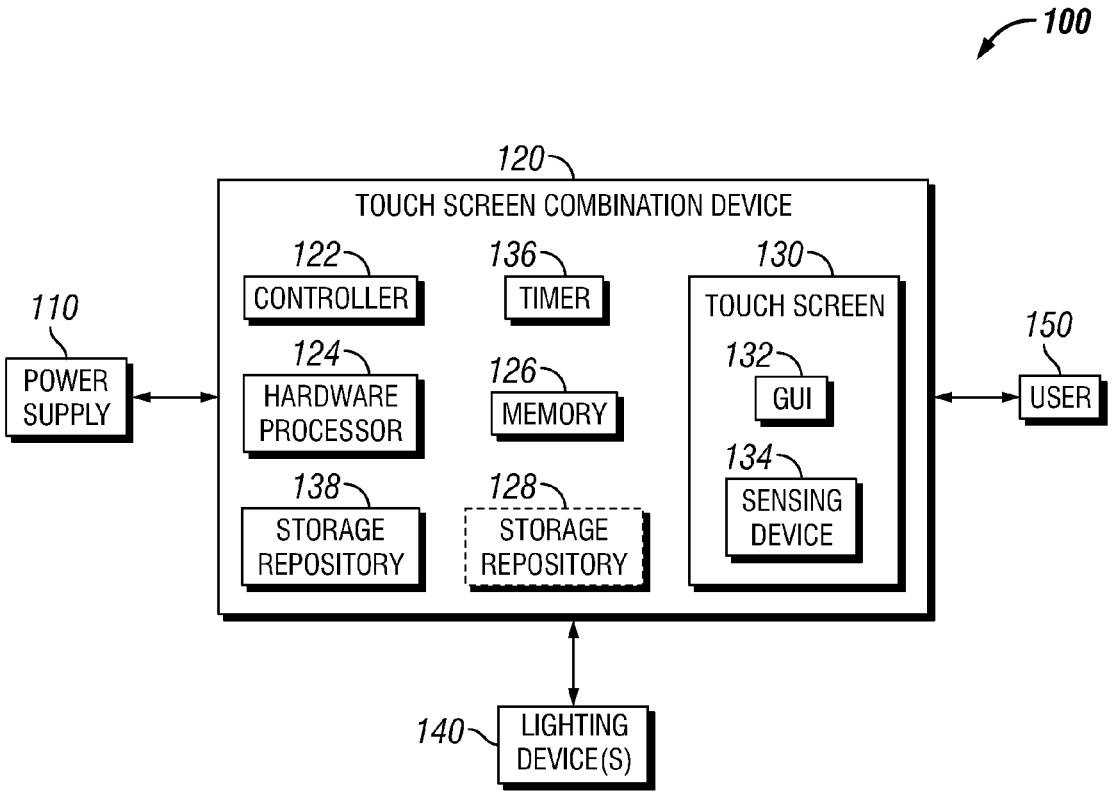
FIG. 1 shows a diagram of an exemplary system for use in incorporating the in-wall switching device with touch screen interface in accordance with one or more exemplary embodiments.

Exemplary embodiments of an in-wall switching device with touch screen interface (also simply called a "device" and/or an "electrical switch device" herein) will now be described in detail with reference to the accompanying figures. Like elements in the various figures are denoted by like reference numerals for consistency. In the following detailed description of the exemplary embodiments, numerous specific details are set forth in order to provide a more thorough understanding of the disclosure herein. However, it will be apparent to one of ordinary skill in the art that the exemplary embodiments herein may be practiced without these specific details. In other instances, well-known features have not been described in detail to avoid unnecessarily complicating the description.

The in-wall switching devices with touch screen interface described herein may include one or more of a number of different types of touch screen technology. For example, a touch screen may require an actual touch by a finger and/or register a finger movement that is proximate to, but without actually touching, the touch screen. The capabilities of a touch screen used with exemplary embodiments described herein may depend on one or more of a number of factors including, but not limited to, functions performed by the in-wall switching device with touch screen interface, footprint into which the device is to fit, the environment in which the device is placed, and the voltage levels of the power source voltages used (e.g., 120 VAC, 240 VAC, 277 VAC).

The in-wall switching devices with touch screen interface described herein may, at least in part, be mechanically coupled to a wall by being mounted within and/or behind the wall. As defined herein, a wall is any type of building material (e.g., drywall, ceiling tiles, brick, plywood, wall studs, cement, cinder blocks) that is used to create a surface (e.g., wall, ceiling, floor) that defines a structure or a space (e.g., room, duct) within a structure. A wall may also include some other object (e.g., a mounting plate, a junction box) adjacent to building material. The surface may be located within the structure or outside the structure. The surface may be in an open area or in an enclosed area.

In one or more exemplary embodiments, an in-wall switching device with touch screen interface is used with a single gang junction box. In such a case, exemplary embodiments of an in-wall switching device with touch screen interface typically meet the standards of a National Electrical Manufacturer's Association (NEMA) 1 enclosure. Alternatively, exemplary in-wall switching devices with touch screen interface described herein may also be used with multiple (e.g., two, three, four) gang junction boxes. In such a case, exemplary embodiments of an in-wall switching device with touch screen interface typically meets the standards set by NEMA for such an enclosure.

FIG. 1 shows a diagram of an system 100 for use with an in-wall switching device with touch screen interface in accordance with one or more exemplary embodiments. Referring now to FIG. 1, the exemplary system 100 includes a power supply 110, an in-wall switching device with touch screen interface 120, one or more lighting devices 140, and a user 150. In one exemplary embodiment, the in-wall switching device with touch screen interface 120 includes a controller 122, a hardware processor 124, memory 126, a touch screen assembly 130, a timer 136, a storage repository 138, and, optionally, a security module 128. In certain exemplary embodiments, the touch screen assembly 130 includes a graphical user interface (GUI) 132 and one or more sensing devices 134. Each of these components is described below. Exemplary embodiments are not limited to the configuration shown in FIG. 1 and discussed herein.

Referring to FIG. 1, the exemplary power supply 110 is one or more sources of energy (e.g., electricity) used to provide power and/or control to the in-wall switching device with touch screen interface 120 and, at times, the one or more lighting devices 140 through the in-wall switching device with touch screen interface 120. The power supply 110 typically provides electricity that is in alternating current (AC) format and/or direct current (DC) format. The power supply 110 may be physically separate from the in-wall switching device with touch screen interface 120 (as with 120 VAC household wiring that is connected to the in-wall switching device with touch screen interface 120) and/or internal within the in-wall switching device with touch screen interface 120 (as with a battery). The amount of voltage delivered by the power supply 110 to the in-wall switching device with touch screen interface 120 may be any amount suitable to operate the elements of the in-wall switching device with touch screen interface 120. In certain exemplary embodiments, the voltage delivered by the power supply 110 is transformed, rectified, inverted, and/or otherwise manipulated, at the power supply 110 and/or within the in-wall switching device with touch screen interface 120, so that the various components of the in-wall switching device with touch screen interface 120 receive a proper voltage level to operate properly.

In one or more exemplary embodiments, the in-wall switching device with touch screen interface 120 controls one or more lighting devices 140. For example, the in-wall switching device with touch screen interface 120 receives an interaction (e.g., a manual touch on the touch screen 130) from the user 150 and, in response, generates and sends one or more instructions based on the interaction received from the user 150. In addition, the in-wall switching device with touch screen interface 120 also receives information from one or more lighting devices 140 and provides visual feedback to the user 150 on the touch screen 130 based on such information. One or more of a number of components (e.g., the controller 122, the hardware processor 124, memory 126, the touch screen assembly 130, the storage repository 138) of the in-wall switching device with touch screen interface 120 are used to perform the various functions of the in-wall switching device with touch screen interface 120. Such components may be discrete components, part of a semiconductor, and/or part of a software-based control circuit.

In one or more exemplary embodiments, the in-wall switching device with touch screen interface 120 is implemented according to a client-server topology. In this example, the in-wall switching device with touch screen interface 120 corresponds to enterprise software running on one or more servers, and in some embodiments may be implemented as a peer-to-peer system, or resident upon a single computing system. In additional exemplary embodiments, the in-wall switching device with touch screen interface 120 is accessible from other machines using one or more application programming interfaces and/or user interfaces (not shown). In one or more exemplary embodiments, the in-wall switching device with touch screen interface 120 is accessible over a network connection (not shown), such as the Internet, by one or more users (e.g., user, data source, image capture device). Further, information and/or instructions received and/or generated by the in-wall switching device with touch screen interface 120 may also be stored and accessed over the network connection.

Alternatively or additionally, in one or more exemplary embodiments, the in-wall switching device with touch screen interface 120 is a local computer system of the user 150. In such embodiments, the in-wall switching device with touch screen interface 120 may, optionally, not be implemented using a client-server topology. For example, the in-wall switching device with touch screen interface 120 may correspond to a portable computer, mobile device, another type of computing device, and/or combination of multiple computing devices. Additionally or alternatively, the in-wall switching device with touch screen interface 120 may be a distributed computer system and/or multi-processor computer system that includes multiple distinct computing devices.

In certain exemplary embodiments, the in-wall switching device with touch screen interface 120 is coupled to an outlet box, as may be used, for example, by a wall-mounted light switch. The in-wall switching device with touch screen interface 120 may be wireless, detachable, and/or portable. In exemplary embodiments, the in-wall switching device with touch screen interface 120 operates as a remote control device. In such a case, the device 120 includes one or more components (e.g., transceiver) configured to allow signals to be sent and/or received wirelessly. Further, in such a case, the in-wall switching device with touch screen interface 120 may be made of two or more components that are detachable (removable) from/attachable to each other. For example, the touch screen interface may be part of a faceplate that is detachable from the rest of the in-wall switching device (which may be called a junction box), and the faceplate and the junction box may be configured to communicate wirelessly with each other when detached. In such a case, a user may detach the faceplate and send signals (using the GUI 132) to the junction box, which in turn sends the signals to one or more lighting devices 140.

The detachable components of the in-wall switching device with touch screen interface 120 may detach/attach using one or more of a number of fastening mechanisms, including but not limited to a spring catch and release, a snap, a slotted receiver, mating threads, and a clamp. When a portion of the in-wall switching device with touch screen interface 120 is detached, the detached components may communicate with each other as long as such components remain within a certain distance of each other. Such a distance will depend on one or more of a number of factors, including but not limited to the wireless technology being used.

In certain exemplary embodiments, the touch screen assembly 130 of the device 120 generates and presents, using the GUI 132, a number of interactive templates to the user 150. The touch screen assembly 130 also receives, based on the interactive template displayed on the GUI 132, interaction from the user 150 through the GUI 132. In one exemplary embodiment, the GUI 132 is further configured to present information associated with the lighting device 140 or fan to the user 150. For example, the GUI 132 may present information associated with a performance parameter (described below) of the lighting device 140.

In certain exemplary embodiments, the touch screen assembly 130 also includes a sensing device 134 to detect one or more interactions of the user 150 with the GUI 132. For example, an interaction is any action created by the user 150 that the sensing device 134 of the touch screen assembly 130 is capable of receiving. An interaction may be referred to as one or more of a number of descriptions, including but not limited to an input, a command, an instruction, and a selection. The exemplary sensing device 134 is configured to determine one or more of a number of interactions from the user 150, including but not limited to a physical touch, a voice command, and a motion at or near the touch screen 130. The interactions from the user 150 determined by the sensing device 134 may be based on the interactive template presented on the GUI 132. The GUI 132 and the sensing device 134 may coordinate to interpret the interactions of the user 150. For example, when the GUI 132 displays an interactive template, the user may perform an interaction (e.g., making a swiping motion from one side of the touch screen 130 to the other side of the touch screen 130), sensed by the sensing device 134, that causes a different interactive template to be displayed on the GUI 132.

The various configurations of the sensing device 134 and/or the GUI 132 vary based on one or more of a number of factors, including but not limited to the size of the in-wall switching device with touch screen interface 120, the technology used by the touch screen assembly 130, and the lighting devices 140 that are being controlled and/or monitored. The touch screen assembly 130 can use one or more of a number of technologies, both currently known and to be discovered, including but not limited to resistive technology, surface acoustic wave technology, capacitive sensing, infrared technology, optical imaging technology, dispersive signal technology, and acoustic pulse recognition technology.

As an example, when the touch screen assembly 130 is used as a touch screen, the touch screen assembly includes a touch screen and a thin film transistor (TFT) screen. In such a case, the touch screen is configured to receive one or more interactions from the user 150, and the TFT screen is configured to generate, based on the one or more interactions from the user 150, an output (e.g., interaction, instruction) for the controller 122. In certain exemplary embodiments, a layer of glass is also be positioned between the touch screen and the TFT screen.

In one exemplary embodiment, the controller 122 is configured to send information (e.g., data, instructions, signals) to and/or retrieve information (e.g., data, interactions) from memory 126, the timer 136, the storage repository 138, the hardware processor 124, the touch screen assembly 130 (including the GUI 132 and the sensing device 134), the security module 128, any other components of the in-wall switching device with touch screen interface 120, the power supply 110, the user 150, and/or the lighting devices 140. Specifically, in certain exemplary embodiments, the controller 122 is configured to receive an interaction, originated by the user 150, from the sensing device 134 of the touch screen assembly 130. The interaction received by the controller 122 from the sensing device 134 may be of any suitable form, including but not limited to a pressure pulse, an electrical signal, and a digital code.

The exemplary controller 122 is further configured to control, based on one or more interactions originated by the user 150, the one or more lighting devices 140. The controller 122 interprets each interaction received from the sensing device 134 and generates a corresponding signal to the appropriate lighting device 140. The controller 122 also may determine, based on the lighting device 140 targeted by an interaction, the appropriate form for the signal used to control the lighting device 140. Examples of controlling a lighting device 140 include, but are not limited to, sending voltage and/or current to turn on the lighting device 140, stopping voltage and/or current to turn off the lighting device 140, adjusting voltage and/or current to (as with a dimmer selection) to adjust an amount of output for the lighting device 140 (e.g., light fixture, ceiling fan), setting a timer for the lighting device 140, and flipping a switch to change a mode of operation (e.g., changing the direction of a ceiling fan) for the lighting device 140. In certain exemplary embodiments, the controller 122 also controls each lighting device 140 using hard wires and/or using wireless technology.

The exemplary controller 122 is also configured to monitor a performance parameter of the lighting device 140. A performance parameter is, for example, one or more characteristics associated with the lighting device 140. The performance parameter may relate to an operating characteristic (e.g., hours of operation, percent of full power, energy consumption, fan direction, energy efficiency rating), a nameplate characteristic (e.g., wattage of bulb, kilowatt rating of fan motor, a manufacturer make and/or model number), and/or any other suitable characteristic. The performance parameter may be directly measured (e.g., current, voltage, hours) or calculated based on one or more measurements.

The exemplary controller 122 may also be equipped with, or have control of, one or more measurement devices (not shown), including but not limited to a volt meter, an ammeter, and a timer 136. In this exemplary embodiment, the controller 122 is configured to read and interpret results of such measurement devices. The controller 122 may further be configured to calculate one or more performance parameters. The formulas to perform such calculations may be stored, for example, in the storage repository 138. For example, the controller 122 is capable of monitoring one or more performance parameters of one or more lighting devices 140 with or without an instruction to do so from the user 150. Those skilled in the art will appreciate that the controller 122 may be embodied in one or more of a number of forms, including but not limited to a microcontroller, a programmable logic controller, and a programmable gate array.

In certain exemplary embodiments, the controller 122 is further configured to send information associated with the performance parameter of each lighting device 140 to the touch screen assembly 130. The controller 122 may send the information to the touch screen assembly 130 in the same format as the format of the interaction received from the touch screen assembly 130. In other words, the electrical and/or digital signals sent between the controller 122 and the touch screen assembly 130 may conform to the same protocols. The exemplary controller 122 may further be configured to implement energy efficiency measures with the touch screen assembly 130. For example, the controller 122 can dim the GUI 132 when, after a first period of time (e.g., five seconds) measured by a timer 136, no interactions are received from the user 150. As another example, the controller 122 can turn off the touch screen assembly 130 when, after a second period of time (e.g., fifteen seconds) measured by the timer 136, no interactions are received from the user 150.

In exemplary embodiments, the one or more lighting devices 140 are any type of light fixture (e.g., a table lamp, a ceiling light, a wall light, a night light). A lighting device may also include devices that may be integrated with a light, including but not limited to a ceiling fan (with or without an attached light). A lighting device may also include other devices that control an electrical load. For example, a lighting device may include a thermostat. Those skilled in the art will appreciate that a lighting device may also be associated with other electronic devices (e.g., television, stereo, speakers) that may be controlled, directly or indirectly, by a combination device. For example, exemplary embodiments may be used to control a downstream receptacle in which one or more electrical appliances are connected. Each wiring device 140 may be configured to communicate with the controller 122 using wired and/or wireless technology.

The user 150 interacts with the in-wall switching device with touch screen interface 120. For example, the user 150 sends commands to and receives information, for example in the form of visual feedback, from the in-wall switching device with touch screen interface 120. For example, the user 150 may touch a specific portion of the GUI 132 on the touch screen assembly 130 to turn on a light. As another example, a user 150 is provided a visual display on the GUI 132 that allows the user to determine that running the ceiling fan and lights to a fixture at a current setting is instantaneously consuming 150 watts.

The user 150 is capable of interacting with the in-wall switching device with touch screen interface 120 using one or more of a number of touching instruments, including, but not limited to, a finger, a stylus, a cursor of a mouse, and a key on a keypad. The user 150 is capable of interacting with the in-wall switching device with touch screen interface 120 in person (e.g., physically touching the GUI 132 on the touch screen assembly 130 with a finger, gesturing in a certain manner within range of a sensor 134 of the touch screen assembly 130) or virtually (e.g., touching a portion of a GUI on an application of a mobile device, which virtually selects a corresponding portion of the GUI 132 of the touch screen assembly 130). The user 150 may be a homeowner, a business owner, a tenant, a landlord, an agent, an administrator, an energy manager, a consultant, a representative of the owner, or some other entity that manages one or more lighting devices 140 controlled by the in-wall switching device with touch screen interface 120.

In one or more exemplary embodiments, the user 150 uses a user system that operates using user software. The exemplary user system is, or may contain a form of, an Internet-based or an intranet-based computer system that is capable of communicating with the user software. A user system may include any type of computing device and/or communication device, including but not limited to the in-wall switching device with touch screen interface 120. Examples of the user system include, but are not limited to, a laptop computer with Internet or intranet access, a smart phone, a server, a server farm, and a personal digital assistant (PDA). In certain exemplary embodiments, the user system corresponds to a computer system as described below with regard to FIG. 5.

The user software may execute on the in-wall switching device with touch screen interface 120 and/or a separate device (e.g., a server, mainframe, desktop personal computer (PC), laptop, personal desktop assistant (PDA), television, cable box, satellite box, kiosk, telephone, mobile phone, or other computing devices) from the in-wall switching device with touch screen interface 120. In certain exemplary embodiments, the device on which the user software executes is coupled by a network (e.g., Internet, intranet, extranet, Local Area Network (LAN), Wide Area Network (WAN), or other network communication methods), with wired and/or wireless segments. The user software may also be part of, or operate separately from but in conjunction with, the in-wall switching device with touch screen interface 120.

Continuing with reference to FIG. 1, the exemplary in-wall switching device with touch screen interface 120 is configured to retrieve and store information, instructions, selections, input, and/or any other interaction received from the user 150. More specifically, the in-wall switching device with touch screen interface 120 is configured to use the controller 122 to retrieve and store information, measurements, instructions, selections, input, and/or any other interaction received from the user 150 and/or a lighting device 140 in the storage repository 138 in accordance with one or more exemplary embodiments.

The exemplary storage repository 138 is a persistent storage device (or set of devices) that stores software and data used to control one or more lighting devices 140. The storage repository 138 may store any type of suitable data associated with the lighting devices 140, including but not limited to operational data, formulas, manufacturing data, and nameplate data. Examples of a storage repository 138 include, but are not limited to, a database (or a number of databases), a file system, a hard drive, some other form of data storage, or any suitable combination thereof. The storage repository 138 may be located on multiple physical machines, each storing all or a portion of the information, measurements, calculations, instructions, selections, input, and/or any other interaction. Each storage unit or device may be physically located in the same or different geographic location, which may be within or outside of the in-wall switching device with touch screen interface 120.

The exemplary hardware processor 124 within the in-wall switching device with touch screen interface 120 is configured to execute software in accordance with one or more exemplary embodiments. Specifically, the hardware processor 124 is configured to execute the instructions used to operate the in-wall switching device with touch screen interface 120, including any of its components, described above and shown in FIG. 1, as well as software used by the user 150 and/or the one or more lighting devices 140. The exemplary hardware processor 124 is an integrated circuit, a central processing unit, a multi-core processing chip, a multi-chip module including multiple multi-core processing chips, or other hardware processor. The hardware processor 124 may be known by other names, including but not limited to a computer processor, a microprocessor, and a multi-core processor.

In one or more exemplary embodiments, the hardware processor 124 is configured to execute software instructions stored in memory 126. The exemplary memory 126 may include one or more cache memories, main memory, and/or any other suitable type of memory. In certain exemplary embodiments, the memory 126 is discretely located within the device 120 relative to the hardware processor 128. In certain configurations, the memory 126 may also be integrated with the hardware processor 128. The controller 122 and/or the hardware processor 124 may be integrated into one or more mixed signal integrated circuits. In such a case, the profile and/or cost of the controller 122 and/or hardware processor 124 may be reduced.

Optionally, in one or more exemplary embodiments, the security module 128 is configured to secure interactions between the in-wall switching device with touch screen interface 120 and the user 150 and/or lighting devices 140. More specifically, the exemplary security module 128 is configured to authenticate communication from software based on security keys verifying the identity of the source of the communication. For example, user software may be associated with a security key enabling the user 150 to interact with the in-wall switching device with touch screen interface 120. Further, the security module 128 may be configured to restrict interactions, the interactive templates displayed on the GUI, lighting devices 140 that can be accessed and/or controlled, and/or transmission of information (e.g., operating status of a light or fan), as well as access to other information. For example, the user 150 may be restricted to only operate certain lighting devices 140 associated with and/or approved for that specific user 150. Further, the user 150 may be restricted to receive operating information associated with particular lighting devices 140 approved for that specific user.

In exemplary embodiments, a timer 136 of the in-wall switching device with touch screen interface 120 is configured to keep clock time and/or track one or more periods of time (e.g., track a fixed period of time, track a running operating time). The timer 136 is configured to track one or more times at a single time. The exemplary timer 136 is also configured to communicate times, as well as receive instructions to start tracking a time period, from the controller 122. For example, the timer 136 is configured to notify the controller 122 when a certain amount of time has lapsed, as when the user 150 sets the lighting device 140 on a timer function. As another example, the timer 136 is configured to measure a period of time (e.g., five seconds) since the most recent interaction with the in-wall switching device with touch screen interface 120 by the user 150 and notify the controller 122. The timer 136 may further be configured to synchronize (e.g., at zero-crossing) with the power provided to the touch screen combination device 120 and/or a lighting device 140 by the power supply 110. In such a case, the timer 136 may track an event with respect to the power and facilitate ease in controlling power delivered to a lighting device 140 for purposes of dimming and/or turning a lighting device on/off.

FIGS. 2A-D show various views of an exemplary in-wall switching device with touch screen interface 200 in accordance with one or more embodiments. Referring now to FIGS. 2A-D, the exemplary in-wall switching device with touch screen interface 200 includes a wall plate 202 having a front panel with an aperture that exposes a portion of a top housing 204 and a touch screen 214. The wall plate may couple to the top housing 204 in one or more of a number of ways, including but not limited to an interlocking snap and a fastening device (e.g., a screw) (not shown). In one or more exemplary embodiments, the dimensions of the wall plate 202 may be any suitable length, width, and/or height. For example, the dimensions of the wall plate 202 for a single gang outlet box are approximately 4¼ inches high and 2¾ inches wide. The wall plate 202 may also be oversized relative to a single gang combination device.

The aperture in the wall plate 202 that exposes the portion of a top housing 204 and the touch screen 214 may be any suitable size (width, height) to allow a user to interact with (e.g., provide manual adjustment access to) the touch screen 214. For example, the aperture in the wall plate 202 may be approximately the same size as the protruding portion of the top housing 204 to secure the top housing 204. In certain exemplary embodiments, the aperture in the wall plate 202 is at least as large as the touch screen 214. The front panel of the wall plate 202 (the portions of the wall plate 202 between the aperture and the outer edges of the wall plate 202) may be of sufficient height/width to secure (for example, by extending over a least a portion of) the top housing 204 and touch screen 214 to the rest of the in-wall switching device with touch screen interface 200. The wall plate 202 may be made of one or more of a number of suitable materials, including but not limited to metal and plastic. In certain exemplary embodiments, when the wall plate 202, the top housing 204, and the touch screen 214 are removable, the assembly of the wall plate 202, the top housing 204, and the touch screen 214 is called a faceplate.

Figure 2A:
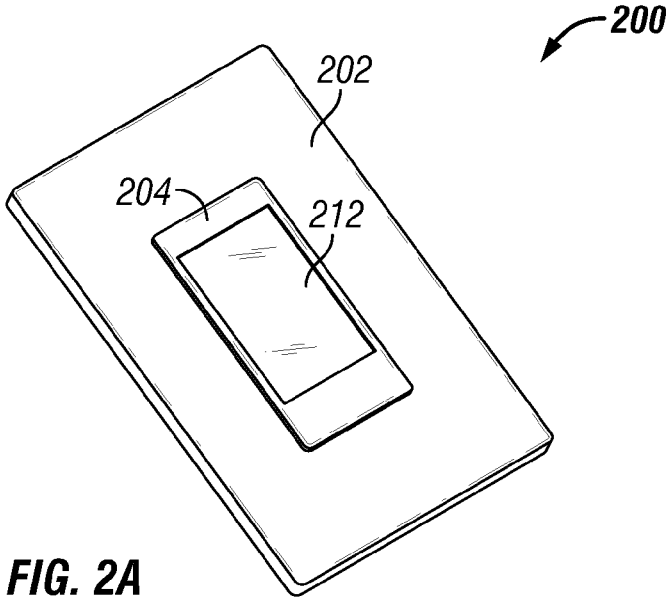
FIGS. 2A through 2D show various views of an exemplary in-wall switching device with touch screen interface in accordance with one or more exemplary embodiments.
Figure 2B:
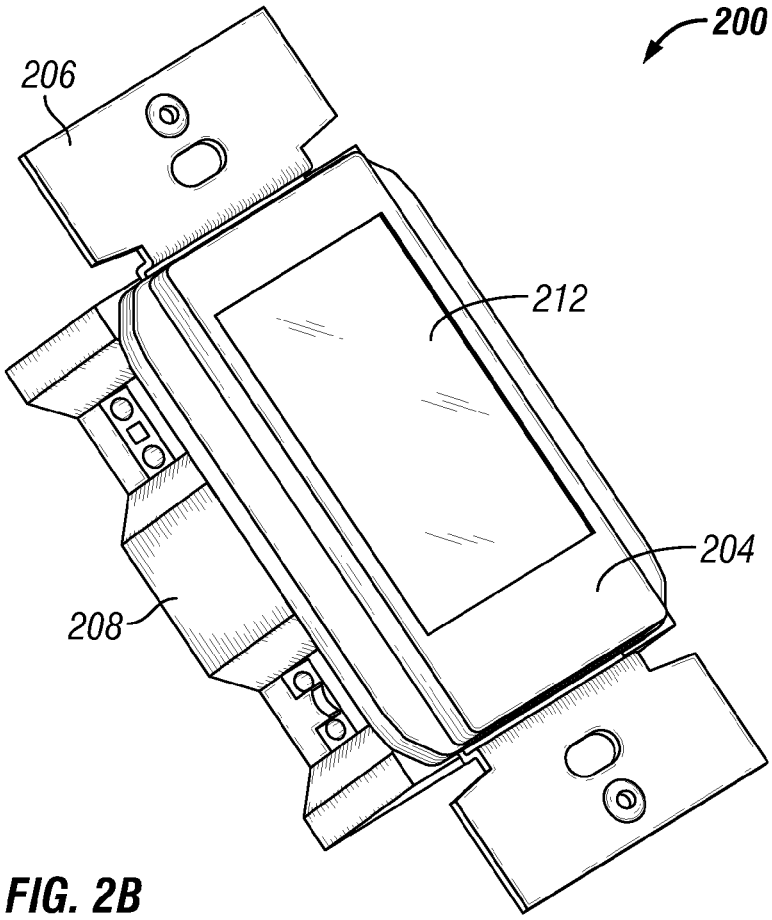
Figure 2C:
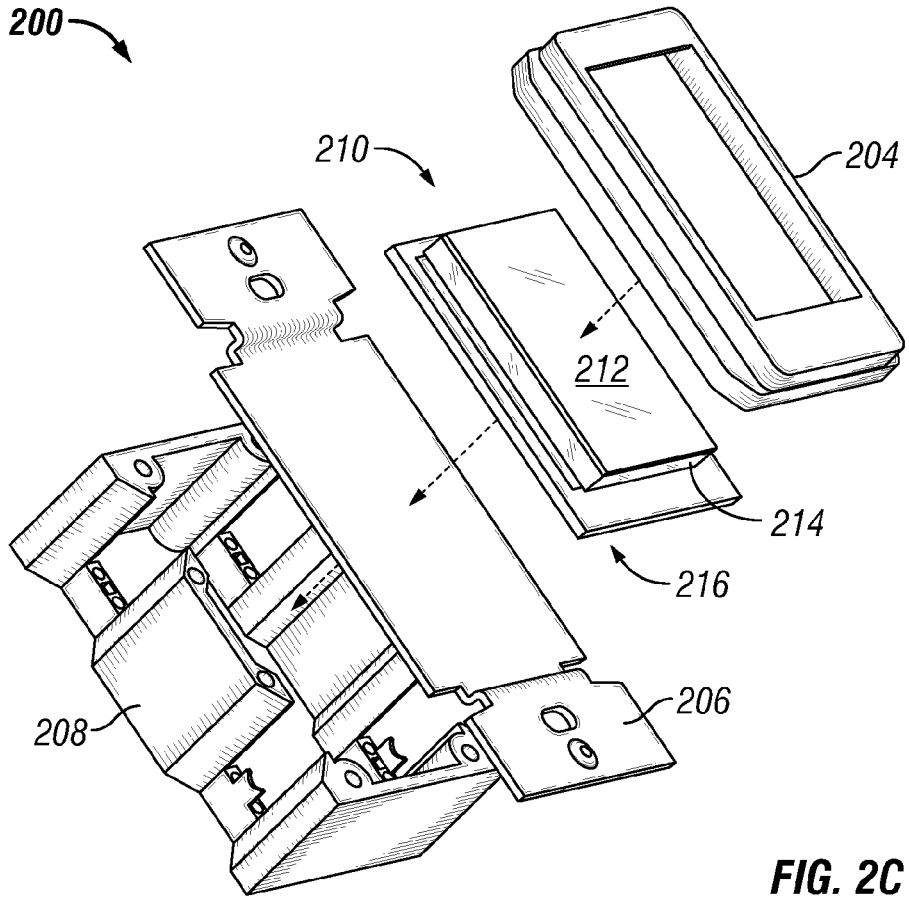

FIG. 2B shows a perspective view of the in-wall switching device with touch screen interface 200. FIG. 2C shows an exploded perspective view of the device 200. The exemplary device 200 includes the top housing 204, a touch screen assembly 210, a mounting strap 206, and a bottom housing 208 (also called an outlet box). In certain exemplary embodiments, the top housing 204 couples to and secures the touch screen assembly 210. In addition, the top housing 204 may be configured to mate with and/or couple to the wall plate 202. For example, the raised profile of the top housing 204 may be of a slightly smaller size than the aperture of the wall plate 202.

The top housing 204 may be made of one or more of a number of suitable materials, including but not limited to metal and plastic. In addition to securing the touch screen assembly 210, the top housing 204 may also be configured to hide one or more components (e.g., wiring, a printed circuit board) inside the in-wall switching device with touch screen interface 200 from view outside the in-wall switching device with touch screen interface 200.

In one exemplary embodiment, the mounting strap 206 is configured to secure the device 200 to a wall. In some exemplary embodiments, the strap mounting 206 is also, or in the alternative, configured to receive a fastening mechanism to couple the mounting strap to the wall plate 202 and/or the bottom housing 208. Such a fastening mechanism may include, but is not limited to, an interlocking snap and a fastening device (e.g., a screw). The exemplary mounting strap 206 has a solid body (as shown in FIG. 2C). Alternatively, the exemplary mounting strap 206 has one or more apertures in its body, for example, to allow wiring to pass through the body of the mounting strap 206.

The exemplary bottom housing 208 includes a back surface and a number of side surfaces that define a cavity that houses (receives) wires (e.g., a power and/or control cable), a battery, a circuit board, and/or any other electrical component. One or more such electrical components may be electrically coupled to the touch screen assembly 210. The bottom housing 208 may also be used to mount to a wall. The exemplary bottom housing 208 may further be configured to couple to the strap 206 in one or more of a number of ways, including but not limited to snap fittings and fastening devices (e.g., screws).

In certain exemplary embodiments, the touch screen assembly 210 is configured to receive and recognize inputs (also called interactions) from a user who interacts with the touch screen 212. The exemplary touch screen assembly 210 shown in FIG. 2B includes a touch screen 212, a layer of glass 214, and a TFT screen 216. The exemplary touch screen 212 is configured to act as a direct interface with the user. In other words, the user may touch and/or otherwise interact with the top surface of the touch screen 212 to communicate with the in-wall switching device with touch screen interface 200. For example, the touch screen 212 may include two or more metallic, electrically conductive and resistive layers that are physically separated by some distance. When an object (e.g., a finger, a stylus) touches the touch screen 212, the two layers make contact at and/or near that point of contact and register a change in electrical current. The touch screen 212 may be solid, clear, opaque (e.g., frosted), semi-transparent, or any other type of shading. The touch screen 212 may be one or more of any number of colors.

The layer of glass 214 typically serves multiple purposes (e.g., acts as a communication medium between the touch screen 212 and the TFT screen 216, act as a medium through which a piezoelectric effect is measured, serves as a supporting substrate). As shown below with respect to FIG. 4C, the layer of glass 214 is optional and may not be included in certain exemplary embodiments. In one or more alternative exemplary embodiments, there is more than one layer of glass. For example, each layer of glass is either stacked next to each other, separated by the touch screen 212, and/or separated by the TFT screen 216.

Figure 2D:
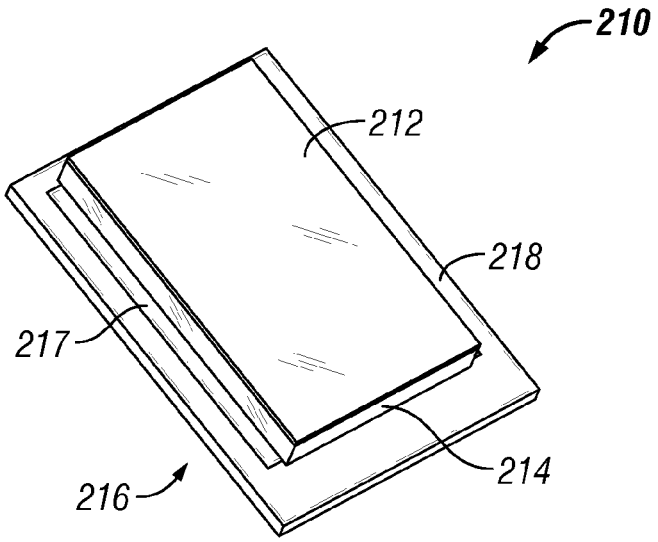

FIG. 2D shows a close-up of the touch screen assembly 210. In exemplary embodiments, the TFT screen 216 includes a transistor area 217 that generates the electrical signals (e.g., changes in voltage, changes in current) that results from an interaction or input (e.g., a touch, a gesture, a voice command) received from the user. The exemplary TFT 216 also includes a border 218, located between the edge of the TFT screen 216 and the transistor area 217, that is electrically neutral. In certain exemplary embodiments, the touch screen 212 and/or the layer of glass 214 are substantially the same size (have the same surface area) as the transistor area 217 of the TFT screen 216.

In this example, the length and width of the touch screen 212, the layer of glass 214, and the transistor area 217 of the TFT screen 216 are substantially similar. For example, the length may be 46.23 mm, and the width may be 29.06 mm. In addition, the glass 214 may have a thickness of 4.4 mm. In addition, the length and/or width of the TFT screen 216 may be greater than the length and/or width of the touch screen 212. In this example, the length of the TFT screen 216 is 55.88 mm. In other words, the surface area of the touch screen 212 is less than the surface area of the TFT screen 216. As another example, the surface are of the touch screen 212 may be between 60% and 90% of the surface area of the TFT screen 216.

FIGS. 3A-D show various views of an alternative exemplary embodiment for a in-wall switching device with touch screen interface 300 in accordance with one or more embodiments. In this example, the size (e.g., length, width, aperture size) of the top plate 304 and the components of the touch screen assembly 310 are different when compared to the size of the top plate 204 and corresponding components of the touch screen assembly 210 shown in FIGS. 2A-D above.

Referring to FIGS. 3A-D, the wall plate 202 is substantially the same as the wall plate described above with respect to FIG. 2A. The exemplary top housing 304 has a narrower profile around its perimeter face, which allows more of the touch screen 312 to be exposed when the top housing 304 is coupled to the touch screen 312. In addition, the exemplary touch screen 312 has two painted portions 313, one along the top end and one along the bottom end of the touch screen 312. Alternatively, a painted portion 313 is provided on only one of the top and bottom ends of the touch screen 312. The painted portions 313 designate areas of the touch screen 312 where an interaction from the user is not registered.

In certain exemplary embodiments, the painted portions 313 designate portions of the touch screen 312 that are not positioned directly above (or otherwise in communication with) a portion of the TFT screen 316. The painted portions 313 may be painted, frosted, taped, and/or otherwise suitably covered to designate the areas of the touch screen 312 where an interaction is not registered. The painted portions 313 may be solid, clear, opaque (e.g., frosted), semi-transparent, and/or any other type of shading. The painted portions 313 may be one or more of any number of colors. In addition, the painted portion 313 at the top of the touch screen 312, the painted portion 313 at the bottom of the touch screen 312, and/or the unpainted portion of the touch screen 312 may have the same and/or different dimensions (height, width), shading, and/or color relative to each other. For example, the painted portion 313 at the top of the touch screen 312, the painted portion 313 at the bottom of the touch screen 312 may be opaque, while the touch screen 312 may be transparent.

The dimensions (e.g., height, width) of the painted portions 313 and/or unpainted portion of the touch screen 312 may vary. For example, the painted portion 313 at the bottom of the touch screen 312 may extend up from the bottom edge of the touch screen 312 to a point less than 25% up a longitudinal length of the touch screen 312. As another example, the painted portion 313 at the top of the touch screen 312 may extend down from the top edge of the touch screen 312 to a point less than twenty five percent down a longitudinal length of the touch screen 312. As another example, the unpainted portion of the touch screen 312 may cover at least 60% of the total surface area for the touch screen 312.

Figure 3A:
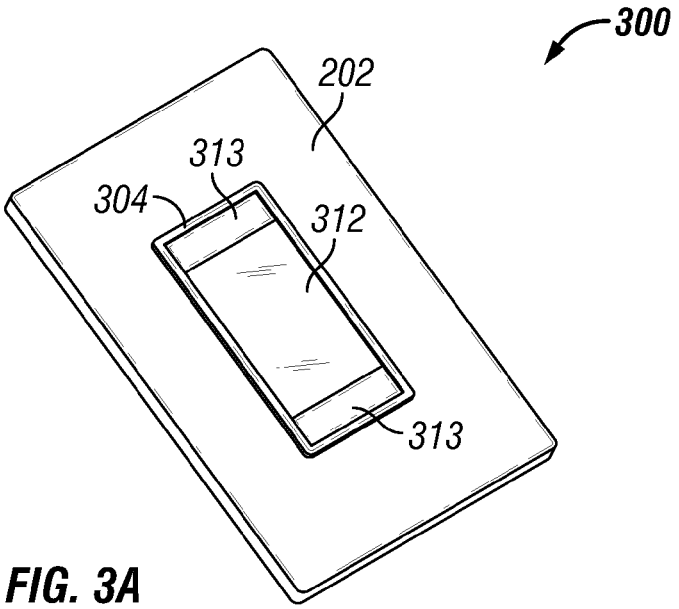
FIGS. 3A through 3D show various views of another exemplary in-wall switching device with touch screen interface in accordance with one or more alternative exemplary embodiments.
Figure 3B:
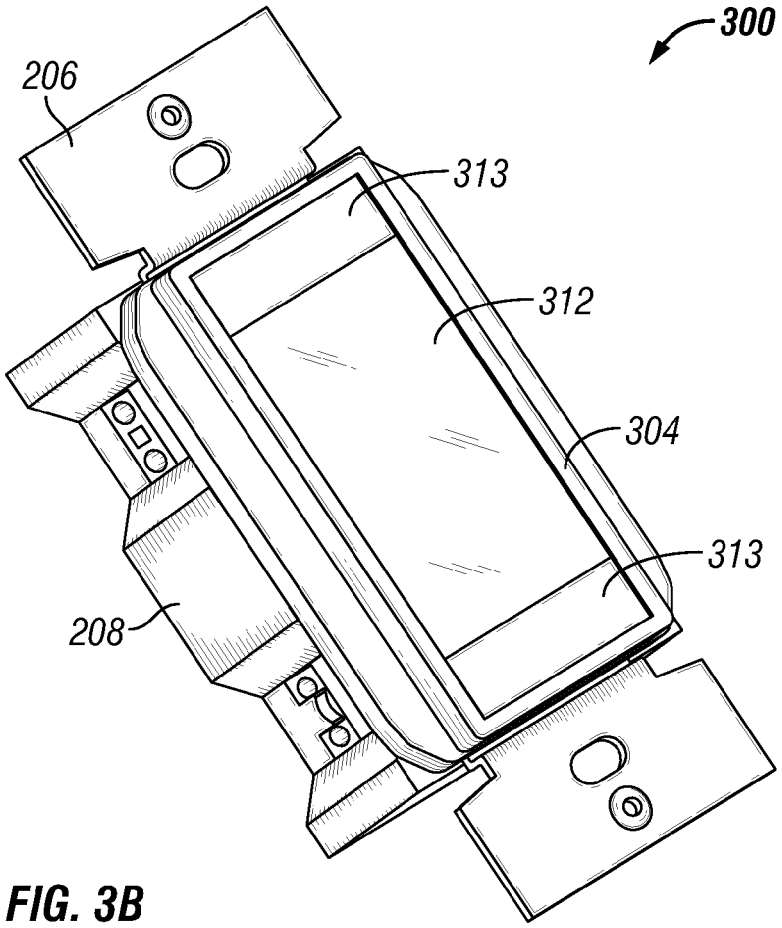
Figure 3C:
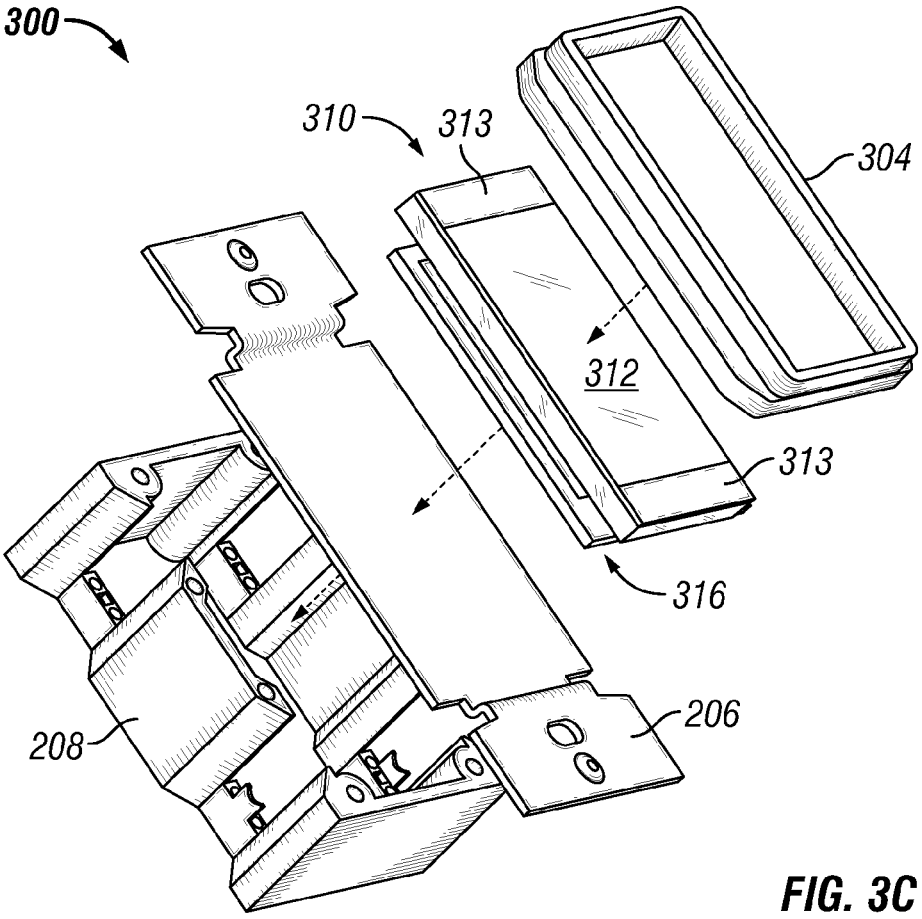

FIG. 3B shows a perspective view of the exemplary in-wall switching device with touch screen interface 300. FIG. 3C shows an exploded perspective view of the exemplary device 300. The mounting strap 206 and the bottom housing 208 are substantially similar to the corresponding components described above with respect to FIGS. 2A-D.

Figure 3D:
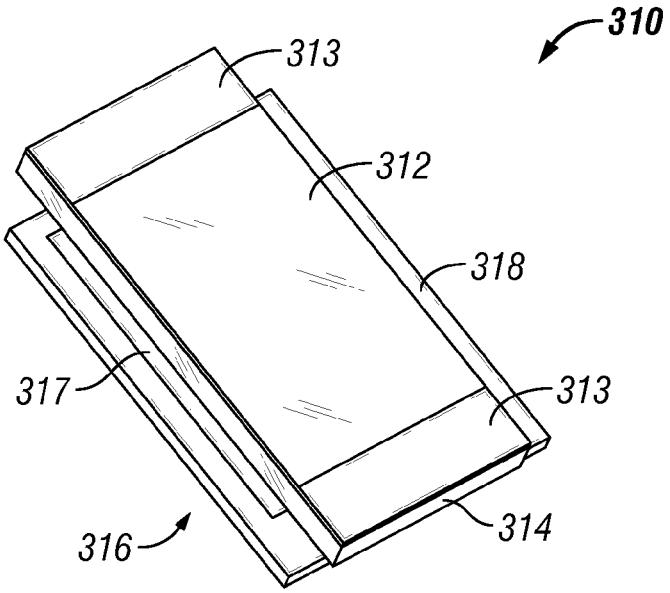

FIG. 3D shows a close-up of the exemplary touch screen assembly 310. In this example, the touch screen 312 and the layer of glass 314 are substantially the same size as each other, but these components are longer than the corresponding components described above with respect to FIGS. 2A through 2D. In this case, the length of the touch screen 312 and the layer of glass 314 is approximately 62.74 mm, while the width of each remains approximately 29.06 mm. In certain exemplary embodiments, in such a case, the dimensions of the touch screen 312 are substantially the same as the aperture in the wall plate 202.

In addition, the dimensions of the TFT screen 316, the transistor area 317, and the border 318 are substantially the same as those described above with respect to FIG. 2D. As a result, the painted portions 313 cover areas of the touch screen 312 where the touch screen 312 does not overlap with the transistor area 317 of the TFT screen 316.

Figure 4A:
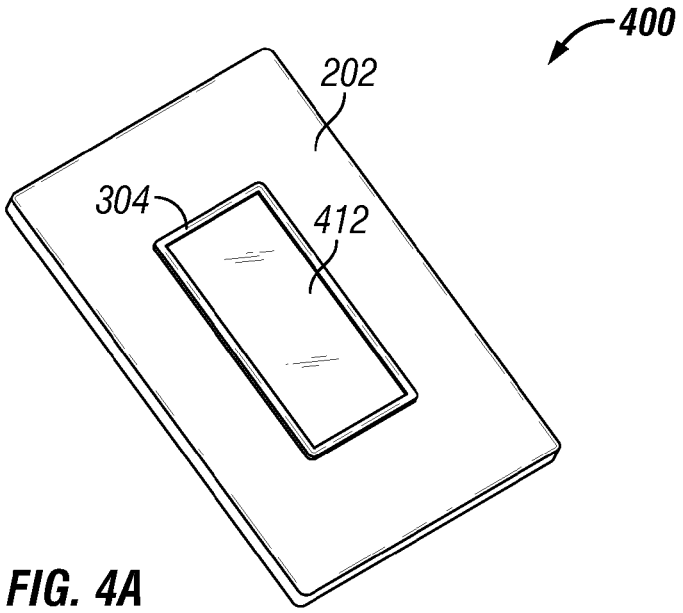
FIGS. 4A through 4C show various views of yet another exemplary in-wall switching device with touch screen interface in accordance with one or more other alternative exemplary embodiments.
Figure 4B:
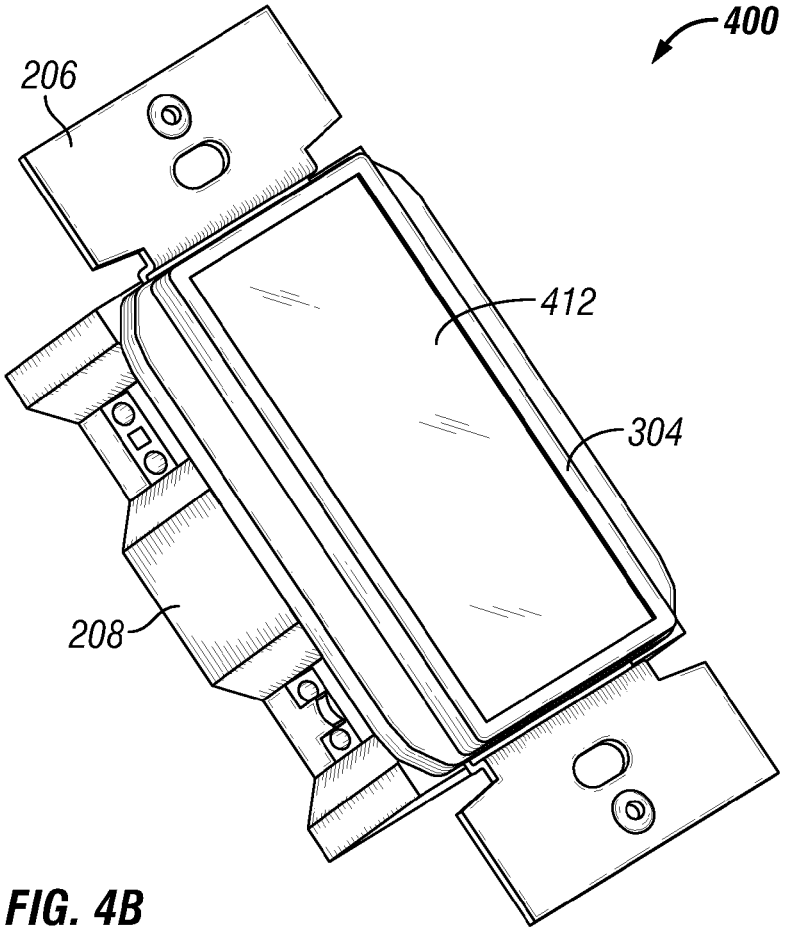
Figure 4C:
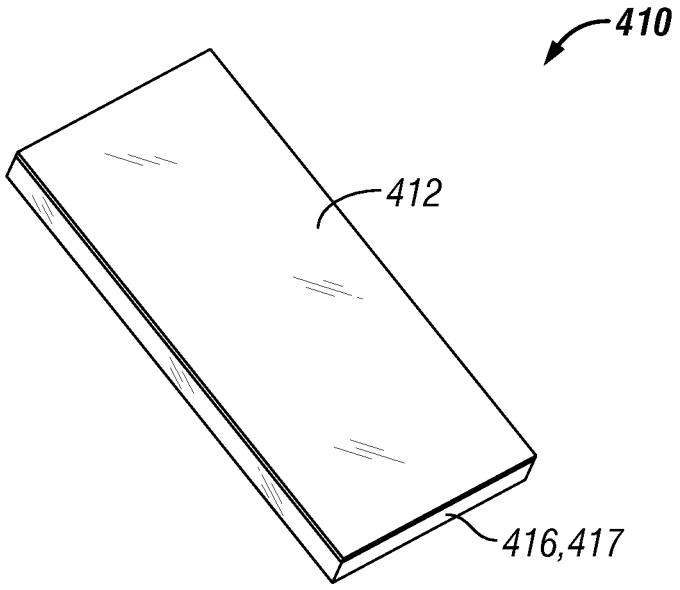

FIGS. 4A-C show various views of another alternative exemplary in-wall switching device with touch screen interface 400 in accordance with one or more exemplary embodiments. Now referring to FIGS. 4A-C, while the profile of the top plate 304 is substantially the same as that described above with respect to FIGS. 3A and 3B, the touch screen 412 has no painted portions. In certain exemplary embodiments, the touch screen 412 has no painted portions because the entire touch screen 412 is configured to register an interaction from a user.

Further, as shown in FIG. 4C, the layer of glass is removed, and the length and width of the touch screen 412 are substantially similar to those of the TFT screen 416. In this case, the length and width of the TFT screen 416 are the same as those of the transistor area 417. In other words, the TFT screen 416 in this case has no border. Here, the length and width of the touch screen 412 and the TFT screen 416 are approximately 62.74 mm and 29.06 mm, respectively. In certain exemplary embodiments, in such a case, the dimensions of the touch screen 312 are substantially the same as the aperture in the wall plate 202. As such, the entire touch screen 312 may register an interaction from a user.

Those skilled in the art will appreciate that other configurations and/or technologies associated with touch screens may be used with exemplary embodiments discussed herein. Further, other interaction sensing technologies (e.g., voice recognition and translation, movement recognition) may be used instead of, or along with, a touch screen assembly in exemplary embodiments.

Figure 5:
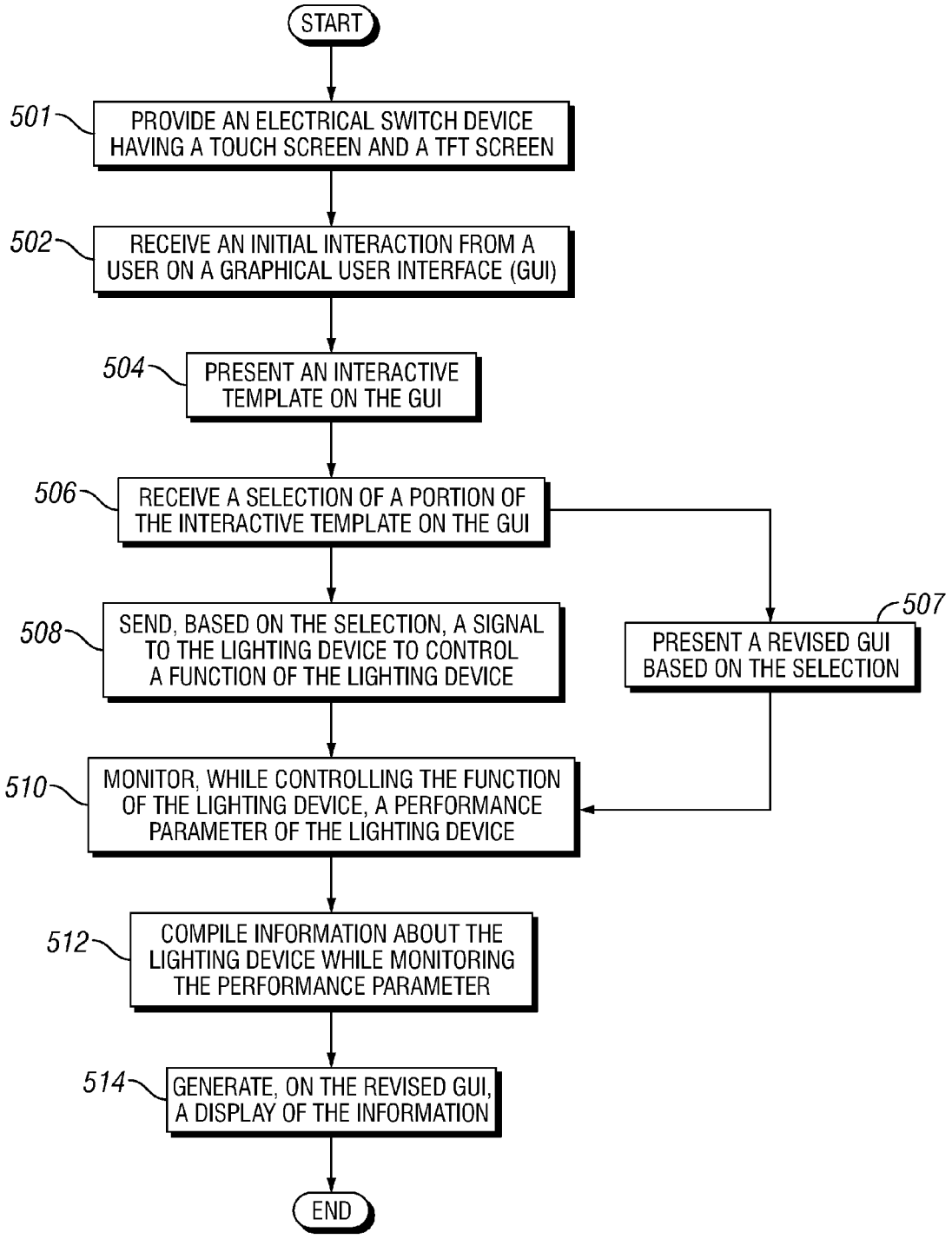
FIG. 5 shows a flowchart of an exemplary method of operation of the exemplary in-wall switching device with touch screen interface in accordance with one or more exemplary embodiments.

FIG. 5 is a flowchart of a method 500 for controlling a lighting device with an exemplary in-wall switching device with touch screen interface in accordance with one or more exemplary embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the exemplary embodiments, one or more of the steps described below may be omitted, repeated, and/or performed in a different order. In addition, a person of ordinary skill in the art will appreciate that additional steps not shown in FIG. 5, may be included in performing this method. Accordingly, the specific arrangement of steps should not be construed as limiting the scope. In addition, a particular computing device, as described, for example, in FIG. 6 below, may be used to perform one or more of the steps for the method 500 described below.

Now referring to FIGS. 1, 2, and 5, the exemplary method 500 begins at the START step and proceeds to Step 501, where an electrical switch device having a touch screen 130 and a TFT screen 216 communicably coupled to the touch screen 130 are provided. The touch screen 130 and the TFT screen 216 communicably coupled to the touch screen may be part of a in-wall switching device with touch screen interface 120. The touch screen 130 and the TFT screen 216 may be communicably coupled using a layer of glass 214.

In step 502, where an initial interaction is received on a GUI 132 from a user 150. In one or more exemplary embodiments, the initial interaction is used to activate (e.g., turn on, bring out of "sleep" mode) an in-wall switching device with touch screen interface 120. The exemplary initial interaction is any communication from the user that the GUI 132 is configured to receive. For example, if the GUI 132 is integrated with a touch screen 130, the initial interaction may include the user touching a finger at any point on the touch screen 130. Examples of other initial interactions include, but are not limited to, a voice command, a gesture, or a movement adjacent to and within a certain distance of the touch screen.

In step 504, an interactive template is presented to the user on the GUI 132. In exemplary embodiments, the interactive template includes at least one feature (e.g., a sliding scale, a pushbutton, a check box) that allows a user to provide an interaction to change a setting to a lighting device 140 (e.g., a lighting fixture, a ceiling fan). The interactive template presented may be one of a number of interactive templates that can be presented on the GUI 132. The interactive template may be a default interactive template, as when the in-wall switching device with touch screen interface 120 is being turned on. The interactive template may also be a most recently displayed interactive template, as when the in-wall switching device with touch screen interface 120 is in "sleep" and/or "dim" mode. The GUI 132 may be presented at the TFT screen 216.

In one exemplary embodiment, the user changes the interactive template (display an alternative interactive template) being presented on the GUI 132 by performing one or more of a number of interactions. For example, the user may make a swiping motion along the GUI 132 from one side of the touch screen 130 to the other side (as in turning a page) to change the interactive template being presented on the GUI 132. Examples of other interactions that the user may perform to change the interactive template being presented on the GUI 132 include, but are not limited to, making a swiping motion between the top and bottom of the touch screen 130 making a swiping motion proximate to the touch screen (without actually touching the touch screen) and saying "page forward." Each GUI 132 presented on the touch screen 130 may include different features that allow various selections, commands, and/or other input to be received from the user 150. In addition, a GUI 132 may change or a new GUI 132 may be presented based on a selection, command, and/or other input received from the user 150 on a previous GUI 132.

In step 506, a selection of a portion of the interactive template is received, at the touch screen 130, on the GUI 132. The selection may be received from a user 150 interacting with (e.g., making a manual contact with) the touch screen 130. In certain exemplary embodiments, the selection is made according to the communication technology used by the with the exemplary in-wall switching device with touch screen interface 120. For example, when a touch screen 130 is used, the user makes a selection by touching the portion of the interactive template (a manual contact) displayed on the GUI 132. The selection on the GUI 132 at the TFT screen 216 that corresponds to the location of the manual contact on the touch screen 130 is then determined. For example, in the case where the interactive template controls a lighting device 140 and includes a sliding bar (i.e., dimmer) and an on/off switch, the user may push the word "ON" on the GUI 132 when the user 150 wants to turn the light on. The user 150 may touch the specific portion of the interactive display (also referred to as an interactive template), or the user may touch an area proximate (e.g., within ½ inch) to the specific portion of the interactive display.

As another example, when a motion sensing screen is used, the user 150 makes a selection (a type of interaction) by making a specific motion or gesture while positioned at a certain distance or range of distances from the GUI 132. Other examples of making a selection of the portion of the interactive template include, but are not limited to, speaking a statement and placing an object within a certain distance of a location on the GUI 132. When step 506 is completed, steps 507 and 508 are performed in parallel.

In step 507, a revised GUI 132 is presented. In certain exemplary embodiments, the revised GUI 132 is based on the selection received from the user 150. The revised GUI 132 may be one or more changes to the GUI 132 described above with respect to step 504. For example, if the user 150 selects, on the GUI 132 in step 506 above, to reduce a fan speed from "HI" to "MED", the revised GUI 132 may change the "HI" portion of the GUI 132 from bright to dim and change the "MED" portion of the GUI 132 from dim to bright. Alternatively, the revised GUI 132 may be a new GUI 132. For example, if the user 150 selects, on the GUI 132 in step 506 above, to reduce a fan speed from "HI" to "OFF", the revised GUI 132 show a new screen stating "Fan is OFF". The revised GUI 132 may be presented substantially immediately after the selection in step 506 is received.

A signal is sent, based on the selection, to the lighting device 140 to control a function of the lighting device 140, in step 508. Specifically, the signal may be sent in response to and corresponding to the selection. The signal may be a control signal (e.g., increase speed of ceiling fan) and/or a power signal (e.g., turn on/off). The signal may be sent through hard wires and/or wirelessly. The function of the lighting device 140 may be any operation that can be electrically controlled, including but not limited to turning the lighting device 140 on/off, and adjusting an output level using a dimmer function. In certain exemplary embodiments, the function may be passive, including, but not limited to, metering and monitoring. In addition, the signal may be sent after a period of time and/or the signal to control the function may cancelled after a period of time (each as determined by a timer set by the user).

In step 510, a performance parameter of the lighting device 140 is monitored. The performance parameter may be monitored while controlling the function of the lighting device 140. The performance parameter may also be monitored continuously or at some other time (e.g., when the device is not off) as determined by default and/or by the user 150. In certain exemplary embodiment, the performance parameter is one or more characteristics associated with the lighting device 140. The exemplary performance parameter typically relates to an operating characteristic (e.g., hours of operation, percent of full power, energy consumption, fan direction, energy efficiency rating), a nameplate characteristic (e.g., wattage of bulb, kilowatt rating of fan motor, a manufacturer make and/or model number), and/or any other suitable characteristic. The performance parameter may be directly measured (e.g., current, voltage, hours) or calculated based on one or more measurements.

In step 512, information about the lighting device 140 is compiled. The information about the lighting device 140 may be compiled in one or more memory/storage components, which may be located within and/or remote from the in-wall switching device with touch screen interface 120. The information may be compiled by one or more processing units executing software instructions based, at least in part, on the selection received from the user 150. In certain examples, the information is compiled while the performance parameter is monitored. The information may also, or additionally, be compiled at any other time. The information compiled may be raw measured data with regard to one or more performance parameters, calculated data, nameplate data, and/or any other suitable information associated with the lighting device 140.

In step 514, a display of the information is generated. The display may be displayed on the revised GUI 132. In certain exemplary embodiments, the information is presented visually to the user 150 on the GUI 132. The information may be presented in one or more of a number of formats. Examples of the formats in which the information may be presented include, but is not limited to, numeric, text, graphical, and animated. The display of the information on the revised GUI 132 may be presented substantially immediately after the information is revised, updated, and/or otherwise generated. The process then continues to the END step.

In one or more exemplary embodiments, the method described herein includes one or more energy saving features. For example, when there has been no interaction (e.g., a selection, an action, a manual contact) received from the user for a period of time (e.g., one minute), the GUI 132 may be dimmed. As another example, when there has been no interaction received from the user for a longer period of time (e.g., five minutes), the GUI 132 may be turned off or terminated. Such examples may be used separately or in conjunction with each other. The enablement and/or settings of an energy saving feature may be set by default, set by the user, and/or set by some other suitable means.

Figure 6:
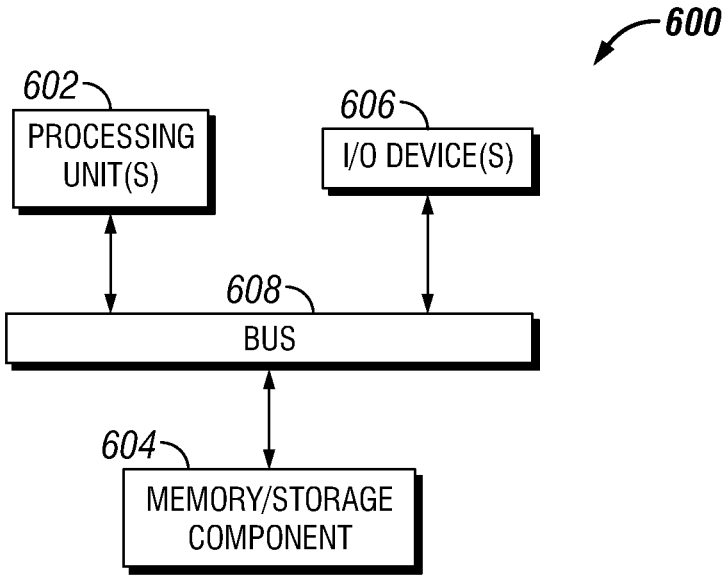
FIG. 6 shows a computer system in accordance with one or more exemplary embodiments.

FIG. 6 illustrates one embodiment of a computing device 600 capable of implementing one or more of the various techniques described herein, and which may be representative, in whole or in part, of the elements described herein. Computing device 600 is only one example of a computing device and is not intended to suggest any limitation as to scope of use or functionality of the computing device and/or its possible architectures. Neither should computing device 600 be interpreted as having any dependency or requirement relating to any one or combination of components illustrated in the example computing device 600.

Computing device 600 includes one or more processors or processing units 602, one or more memory/storage components 604, one or more input/output (I/O) devices 606, and a bus 608 that allows the various components and devices to communicate with one another. Bus 608 represents one or more of any of several types of bus structures, including a memory bus or memory controller, a peripheral bus, an accelerated graphics port, and a processor or local bus using any of a variety of bus architectures. Bus 608 can include wired and/or wireless buses.

Memory/storage component 604 represents one or more computer storage media. Memory/storage component 604 may include volatile media (such as random access memory (RAM)) and/or nonvolatile media (such as read only memory (ROM), flash memory, optical disks, magnetic disks, and so forth). Memory/storage component 604 can include fixed media (e.g., RAM, ROM, a fixed hard drive, etc.) as well as removable media (e.g., a Flash memory drive, a removable hard drive, an optical disk, and so forth).

One or more I/O devices 606 allow a customer, utility, or other user to enter commands and information to computing device 600, and also allow information to be presented to the customer, utility, or other user and/or other components or devices. Examples of input devices include, but are not limited to, a keyboard, a cursor control device (e.g., a mouse), a microphone, and a scanner. Examples of output devices include, but are not limited to, a display device (e.g., a monitor or projector), speakers, a printer, and a network card.

Various techniques may be described herein in the general context of software or program modules. Generally, software includes routines, programs, objects, components, data structures, and so forth that perform particular tasks or implement particular abstract data types. An implementation of these modules and techniques may be stored on or transmitted across some form of computer readable media. Computer readable media may be any available non-transitory medium or non-transitory media that can be accessed by a computing device. By way of example, and not limitation, computer readable media may comprise "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The computer device 600 may be connected to a network (not shown) (e.g., a local area network (LAN), a wide area network (WAN) such as the Internet, or any other similar type of network) via a network interface connection (not shown). Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means may take other forms, now known or later developed. Generally speaking, the computer system 600 includes at least the minimal processing, input, and/or output means necessary to practice one or more embodiments.

Further, those skilled in the art will appreciate that one or more elements of the aforementioned computer device 600 may be located at a remote location and connected to the other elements over a network. Further, one or more exemplary embodiments may be implemented on a distributed system having a plurality of nodes, where each portion of the implementation (e.g., controller 122, touch screen assembly 130) may be located on a different node within the distributed system. In one or more embodiments, the node corresponds to a computer system. Alternatively, the node may correspond to a processor with associated physical memory. The node may alternatively correspond to a processor with shared memory and/or resources.

The following description (in conjunction with FIGS. 1 through 6) describes an example in accordance with one or more exemplary embodiments. The example is for explanatory purposes only and is not intended to limit the scope. Terminology used in FIGS. 1-6 may be used in the example without further reference to those figures.

Example

Referring to FIGS. 1-7E, consider the following example, using the in-wall switching device with touch screen interface 700 (of FIGS. 7A-I), described above. As shown in FIG. 7A, the GUI 702 of the in-wall switching device with touch screen interface 700 is turned off. The GUI 702 may be off because no interaction had been received by the user for some period of time. The GUI 702 may also be off because the user manually turned the GUI 702 off. To turn the GUI 702 on, the user touches the touch screen 704 (for example, with a finger or stylus) at any point on the touch screen 704.

Figure 7A:
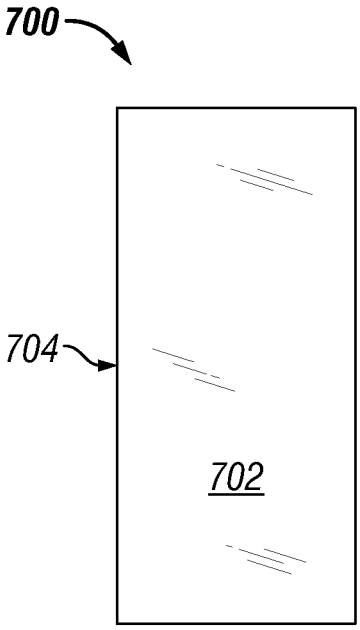
FIGS. 7A through 7I show an example display and operation of the touch screen interface on the exemplary in-wall switching device in accordance with one or more exemplary embodiments.
Figure 7B:
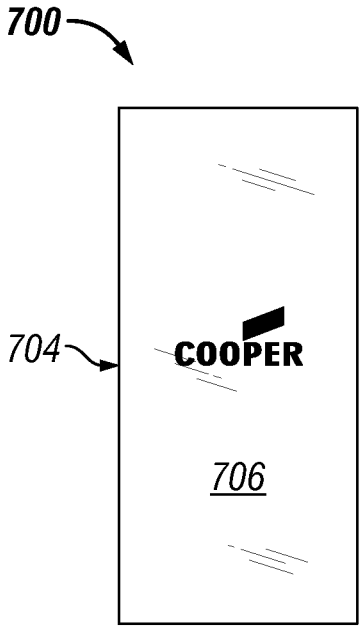

After a second or two, as shown in FIG. 7B, as the touch screen 704 warms up, a GUI 706 showing an advertisement (e.g., a manufacturer, a product name) may appear momentarily. After a few more seconds, as shown in FIG. 7C, a GUI 708 for control of a lighting fixture appears on the touch screen 704.

Figure 7C:
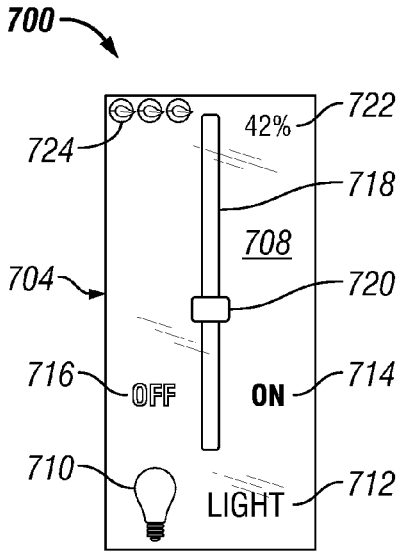

The GUI 708 of FIG. 7C includes several features. On the lower portion of the GUI 708 is an icon 710 of a light bulb and the word "LIGHT" 712 to denote that the controls and information shown on the GUI 708 are for the light fixture associated with the in-wall switching device with touch screen interface 700. If there is more than one light fixture associated with the in-wall switching device with touch screen interface 700, then additional information (additions and/or changes) may be displayed on the GUI 708 to communicate which particular lighting fixture is the subject of the GUI 708. For example, the word "Ceiling light" or "table lamp next to entrance door" may replace the word "LIGHT" 712.

Continuing with FIG. 7C, the middle portion of the GUI 708 includes a slide bar 718 with a slider 720 that simulate a dimmer switch. The level of light given off by the light fixture is determined by the position of the slider 720 on the slide bar 718. In addition, the position of the slider 720 on the slide bar 718 is shown numerically as a percentage 722 in the upper right of the GUI 708. In this example, the percentage 722 is 42%. The slider 720 may be repositioned on the slide bar 718 in one or more of a number of ways. For example, the user may touch a finger on the slider 720 at its current location, move his finger up or down the slide bar while maintaining contact with the touch screen 704, and remove his finger from the touch screen at the target location on the slide bar 718. As another example, the user may tap the slider 720 on the touch screen 704 with a stylus and subsequently tap a target location of the slide bar 718 on the touch screen 704 with the stylus.

The lighting device may also be turned on and off by touching the "ON" 714 and "OFF" 716 words, respectively, on the GUI 708. The GUI 708 may also display an efficiency level 724, as shown in the upper left portion of the GUI 708. In this case, the higher the efficiency, the more leaves that are shown for the efficiency level 724 on the GUI 708.

Figure 7D:
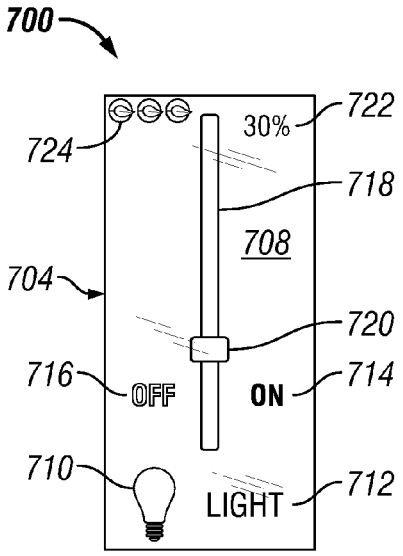

In this example the user places a finger on the slider 720 at its current location of 42%, moves his finger down the slide bar while maintaining contact with the touch screen 704, and removes his finger from the touch screen at the target location of 30% on the slide bar 718. The end result is shown in FIG. 7D. When the dimmer is set to 30% on the GUI 708, the controller in the in-wall switching device with touch screen interface 700 sends a signal (e.g., reduced voltage and/or current) to the lighting fixture to illuminate at 30% of the rated wattage for the lighting element of the light fixture. The user then wants to control the ceiling fan associated with the in-wall switching device with touch screen interface 700. To do so, the user swipes his finger from the right side of the touch screen to the left side of the touch screen. The resulting screen is shown in FIG. 7E.

Figure 7E:
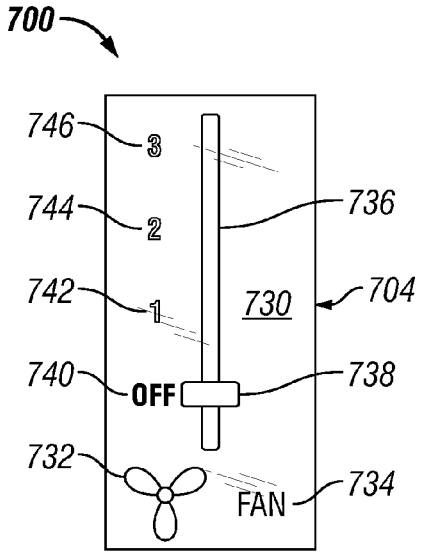

FIG. 7E shows a GUI 730 for controlling a ceiling fan. On the lower portion of the GUI 730 is an icon 732 of a fan and the word "FAN" 734 to denote that the controls and information shown on the GUI 730 are for the ceiling fan associated with the in-wall switching device with touch screen interface 700. If there is more than one ceiling fan associated with the in-wall switching device with touch screen interface 700, then additional information (additions and/or changes) may be displayed on the GUI 730 to communicate which particular ceiling fan is the subject of the GUI 730.

Continuing with FIG. 7E, the middle portion of the GUI 730 includes a slide bar 736 with a slider 738 that simulate a slidable fan setting switch. The speed of the ceiling fan is determined by the position of the slider 738 on the slide bar 736. Here, rather than a percentage, the slide bar 736 has discrete settings of "OFF" 740, speed 1 742, speed 2 744, and speed 3 746. In one or more exemplary embodiments, speed 1 742 may be replaced with "LOW," speed 2 744 may be replaced with "MEDIUM," and speed 3 746 may be replaced with "HIGH." As with the slider 720 described above with respect to FIG. 7C, the slider 738 may be repositioned on the slide bar 736 in one or more of a number of ways.

Figure 7F:
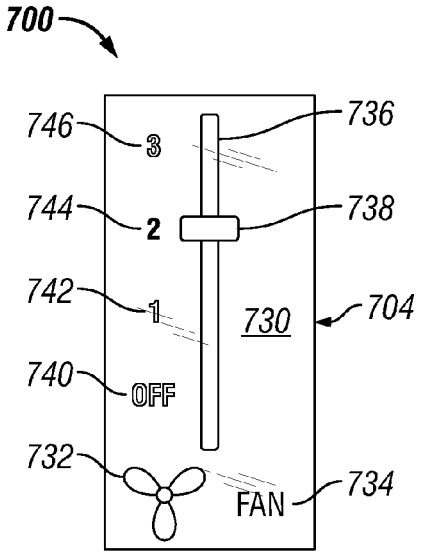

In this example, the user turns on the ceiling fan to speed 2 744 (medium speed) by tapping a stylus at level 2 744 on the slide bar 736 of the GUI 730. The result of the user's actions with regard to the ceiling fan from FIG. 7E is shown in FIG. 7F. When the fan control is set to level 2 744 on the GUI 730, the controller in the in-wall switching device with touch screen interface 700 sends a signal (e.g., reduced voltage and/or current) to the ceiling fan to run the fan motor at medium speed. The user then wants to set a timer for the light and ceiling fan. To access the appropriate GUI, the user again swipes his finger from the right side of the touch screen to the left side of the touch screen. The resulting screen is shown in FIG. 7G.

Figure 7G:
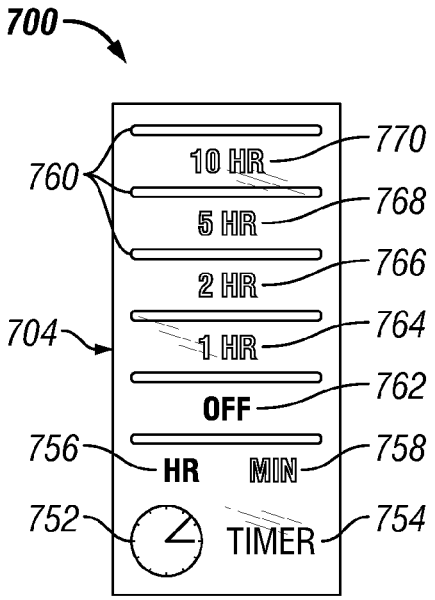

FIG. 7G shows a GUI 750 for controlling a timer function. On the lower portion of the GUI 750 is an icon 752 of a clock and the word "TIMER" 754 to denote that the controls and information shown on the GUI 750 are for a timer for one or more lighting devices associated with the in-wall switching device with touch screen interface 700. If there is more than one lighting device associated with the in-wall switching device with touch screen interface 700 that can be controlled by the timer, then additional information (additions and/or changes) may be displayed on the GUI 750 to communicate which particular lighting devices are subject to the timer settings on the GUI 750. In this example, both the lighting fixture of FIG. 7C and the ceiling fan of FIG. 7E are subject to the timer settings.

Continuing with FIG. 7G, the middle portion of the GUI 750 includes a number of timer settings that are separated from each other by a series of parallel lines 760. Just above the icon 752 and word "TIMER" 754 on the GUI 750 are selections for hours HR 756 and minutes 758. In this example, HR 756 is selected because it is shown in bold on the GUI 750, and MIN 758 is deselected because it is shown in shadow on the GUI 750. Further up on the GUI 750 are a number of time increment selections. In this example, the time increment selections are "OFF" 762, "1" 764, "2" 766, "5" 768, and "10" 770. The selected time measure (HR 756) appears after each time increment selection (e.g., 1 HR 764, 10 HR 770). In FIG. 7G, "OFF" 762 is currently selected because it is the only time increment selection that is shown in bold on the GUI 750.

Figure 7H:
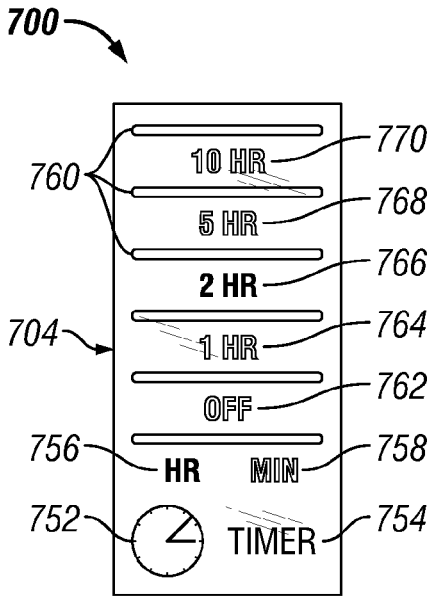
Figure 7I:
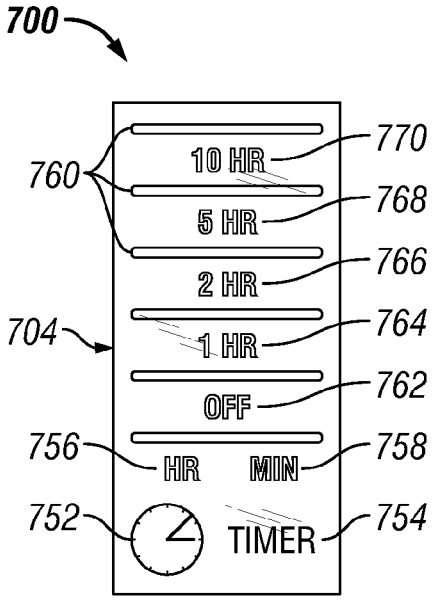

To set the timer for 2 hours, the user selects leaves the time measure of HR 756 selected and selects 2 HR 766. The result of this selection by the user is shown in FIG. 7H. In other words, the light fixture and the ceiling fan will turn off, based on a signal (e.g., cut power) sent in two hours by the controller in the in-wall switching device with touch screen interface 700 to the light fixture and the ceiling fan. If there is not further interaction from the user after one minute, then the GUI 750 dims, as shown in FIG. 7I. If, after an additional four minutes, there is no further interaction from the user, the in-wall switching device with touch screen interface 700, including the GUI 750, shuts off, as shown in FIG. 7A.

Exemplary embodiments described herein are directed to combination devices. Using exemplary embodiments, a wide array of functionality (e.g., controlling, monitoring) with regard to one or more lighting devices is achieved in a constrained space. Exemplary embodiments replace mechanical actuators, such as switches, levers, and pushbuttons.

In one or more exemplary embodiments, multiple control interfaces (e.g., lighting device, ceiling fan) are offered using a single interface (e.g., a touch screen). By the use of a GUI displaying a number of interactive templates, such single interface is easy for the user to navigate and operate. Specifically, the user will easily be able to change interactive templates to control one or more functions of a single lighting device and/or of multiple lighting devices. The user will also easily be able to request and receive information (e.g., operational data, manufacturing data) for one or more lighting devices.

Because of the ease with which a user can control and monitor one or more lighting devices using exemplary embodiments described herein, the user may be able to more easily institute energy efficiency measures and institute voluntary and/or compliance demand response measures.

Although embodiments described herein are made with reference to exemplary embodiments, it should be appreciated by those skilled in the art that various modifications are well within the scope and spirit of this disclosure. Those skilled in the art will appreciate that the exemplary embodiments described herein are not limited to any specifically discussed application and that the embodiments described herein are illustrative and not restrictive. From the description of the exemplary embodiments, equivalents of the elements shown therein will suggest themselves to those skilled in the art, and ways of constructing other embodiments using the present disclosure will suggest themselves to practitioners of the art. Therefore, the scope of the present invention is not limited herein.

We claim:

1. An electrical switch device, comprising:

a mounting strap coupleable to an in-wall junction box;

a touch screen assembly comprising:

a touch screen; and a thin film transistor screen communicably coupled to the touch screen; and a housing coupled to the mounting strap, wherein the housing comprises a plurality of surfaces defining a cavity, wherein the cavity is configured to receive a plurality of electrical components to electrically couple the touch screen assembly to a source of electrical power, wherein the touch screen assembly controls a plurality of lighting devices, wherein each lighting device of the plurality of lighting devices is controlled independently of a remainder of the plurality of lighting devices, and wherein the housing, when coupled with the mounting strap, the touch screen, and the plurality of electrical components, comply with a standard for a National Electrical Manufacturer's Association 1 enclosure.

2. The electrical switch device of claim 1, wherein the touch screen assembly further comprises a glass layer disposed between the touch screen and the thin film transistor, wherein the thin film transistor screen is communicably coupled to the touch screen through the glass layer.

3. The electrical switch device of claim 1, further comprising a top housing member coupled to the mounting strap, the top housing member comprising:

a front panel; and an aperture disposed through a portion of the front panel, wherein the front panel extends over at least a portion of the touch screen, and wherein at least another portion of the touch screen is accessible through the aperture in the front panel.

4. The electrical switch device of claim 1, wherein touch screen comprises a first portion and a second portion, wherein the first portion of the touch screen is transparent and the second portion of the touch screen is opaque.

5. The electrical switch device of claim 4, wherein the touch screen further comprises a third portion, wherein the third portion of the touch screen is opaque and wherein the first portion is disposed between the second portion and the third portion.

6. The electrical switch device of claim 4, wherein the first portion covers at least sixty percent of a total surface area for the touch screen.

7. The electrical switch device of claim 1, further comprising a junction box, wherein the device is removably coupled to the junction box, and wherein the junction box is a single gang junction box.

8. The electrical switch device of claim 1, further comprising a faceplate removably coupled to the mounting strap, the faceplate comprising:

a front panel; and an aperture disposed through the front panel, wherein the aperture is configured to provide manual adjustment access to at least a portion of the touch screen therethrough.

9. The electrical switch device of claim 8, wherein the touch screen has a first total surface area, wherein the thin film transistor screen has a second total surface area, and wherein the first total surface area is less than the second total surface area.

10. The electrical switch device of claim 9, wherein first total surface area is greater than sixty percent of the second total surface area but less than ninety percent of the second total surface area.

11. The electrical switch device of claim 10, wherein the first total surface area is substantially equal to an area of the aperture disposed through the front panel.

12. The electrical switch device of claim 1, wherein the touch screen assembly is configured to display a timer, wherein the timer is applied to each lighting device of the plurality of lighting devices.

13. A method for controlling a plurality of lighting devices, the method comprising:

providing an electrical switch device comprising a touch screen and a thin film transistor (TFT) screen communicably coupled to the touch screen, wherein the electrical switch device complies with a standard for a National Electrical Manufacturer's Association 1 enclosure;

presenting a first interactive template of a plurality of interactive templates on a graphical user interface (GUI) at the TFT screen, wherein the first interactive template corresponds to a first lighting device of the plurality of lighting devices;

receiving, at the touch screen, a first selection of a portion of the first interactive template on the GUI at the TFT screen; and sending a signal to the first lighting device to control a function of the first lighting device in response to and corresponding to the first selection, wherein the first lighting device comprises at least one selected from a group consisting of a lighting fixture and a ceiling fan, and wherein at least a portion of the electrical switch device is mechanically coupled to a wall.

14. The method of claim 13, further comprising the steps of:

monitoring, while controlling the function of the first lighting device, a performance parameter of the first lighting device; and compiling information based on monitoring the performance parameter; and generating a display, on the GUI at the TFT screen, of the information.

15. The method of claim 13, further comprising the steps of:

detecting, while presenting the first interactive template, a manual contact on the touch screen;

determining a second selection on the GUI at the TFT screen that corresponds with a location of the manual contact on the touch screen; and generating a display of a second interactive template at the GUI at the TFT screen in place of the first interactive template.

16. The method of claim 13, further comprising the steps of:

determining if a first period of time has elapsed since a manual contact with the touch screen has occurred; and dimming the display at the GUI at the TFT screen based on a positive determination that the first period of time has elapsed.

17. The method of claim 16, further comprising the steps of:

determining if a second period of time has elapsed since a manual contact with the touch screen has occurred; and terminating the display at the GUI at the TFT screen based on a positive determination that the second period of time has elapsed, wherein the second period of time is greater than the first period of time.

18. The method of claim 13, further comprising the steps of:

presenting a second template of the plurality of interactive templates on the GUI at the TFT screen, wherein the second template corresponds to a second lighting device of the plurality of lighting devices; and receiving, at the touch screen, a second selection of a portion of the second interactive template on the GUI at the TFT screen; and sending a signal to the second lighting device to control a function of the second lighting device in response to and corresponding to the second selection.

19. A computer readable medium comprising computer readable program code embodied therein for performing a method for controlling a first lighting device of a plurality of lighting devices, the method comprising:

presenting a first interactive template of a plurality of interactive templates on a graphical user interface (GUI) at a thin film transistor (TFT) screen of an electrical switch device, wherein the first interactive template corresponds to a first lighting device of the plurality of lighting devices;

receiving, at a touch screen communicably coupled to the TFT screen, a first selection of a portion of the first interactive template on the GUI at the TFT screen; and sending a signal to the first lighting device to control a function of the first lighting device in response to and corresponding to the first selection, wherein at least a portion of the electrical switch device is mechanically coupled to a wall, and wherein the electrical switch device complies with a standard for a National Electrical Manufacturer's Association 1 enclosure.

20. The computer readable medium of claim 19, the method further comprising:

detecting, while presenting the first interactive template, a manual contact on the touch screen;

determining a second selection on the GUI at the TFT screen that corresponds with a location of the manual contact on the touch screen; and generating a second interactive template at the GUI at the TFT screen in place of the first interactive template, wherein the second interactive template is a modification of the first interactive template.

21. The computer readable medium of claim 19, the method further comprising:

detecting, while presenting the first interactive template, a manual contact on the touch screen;

determining that the manual contact is a command to display a different interactive template; and generating a display of the different interactive template at the GUI at the TFT screen in place of the first interactive template, wherein the manual contact is a swiping motion across the touch screen, and wherein the different interactive template is a replacement of the first interactive template.

* * * * *